United States Patent [19]

Nebashi et al.

[11] Patent Number: 5,004,515

[45] Date of Patent: Apr. 2, 1991

[54] AUTOMATIC PAPER FEEDER

[75] Inventors: Yukichi Nebashi; Takaaki Wada, both of Nagano, Japan

[73] Assignee: Kabushiki Kaisha Sankyo Seiki Seisakusho, Nagano, Japan

[21] Appl. No.: 184,917

[22] Filed: Apr. 22, 1988

[51] Int. Cl.[5] ..... B32B 31/00; B31F 5/00

[52] U.S. Cl. ..... 156/350; 156/505; 156/507; 156/545; 156/554; 271/103; 271/243

[58] Field of Search ..... 156/502, 504, 505, 506, 156/509, 507, 350, 545, 554; 271/250, 94, 95, 97, 98, 102, 146, 93, 243, 244, 264, 103, 241, 242; 294/64.1, 907; 414/907

[56] References Cited

U.S. PATENT DOCUMENTS

| | | | |
|---|---|---|---|
| 4,256,248 | 3/1981 | Lapp et al. | 226/118 |
| 4,289,556 | 9/1981 | Booth | 156/506 |
| 4,539,794 | 9/1985 | Azzaroni | 271/303 |
| 4,625,953 | 12/1986 | Hamatani | 271/102 |
| 4,766,322 | 8/1988 | Hashimoto | 901/9 |
| 4,832,786 | 5/1989 | Meschi | 156/506 |

FOREIGN PATENT DOCUMENTS 61-145058 7/1986 Japan .

145058 7/1986 Japan .

OTHER PUBLICATIONS

English Abstract of Horisawa Reference, "Jointing Method & Device for Continued Slip", 11/21/86, Abst. Group M537, vol. 10, No. 346.

*Primary Examiner*—Michael W. Ball
*Assistant Examiner*—Chester T. Barry
*Attorney, Agent, or Firm*—Sughrue, Mion, Zinn, Macpeak & Seas

[57] ABSTRACT

An automatic paper feeder automatically couples a plurality of pieces of folded long paper to each other and then continuously feeds the pieces. A conveyor, a reference surface, a pusher and a drive unit are provided in the feeder. The conveyor has a larger width than the long paper and is made of a material of low friction so as to convey the long paper. The reference surface is located near the side edge of the conveyor. The pusher is disposed opposite said reference surface and can be reciprocated toward and away from the reference surface. The drive unit is for moving the pusher. The pusher is moved by the drive unit to push the long paper onto the reference surface.

7 Claims, 13 Drawing Sheets

AUTOMATIC PAPER FEEDER

BACKGROUND OF THE INVENTION

The present invention relates to an apparatus which automatically couples the edges of pieces of zigzag-folded long paper to each other and then automatically feeds the coupled pieces of zigzag-folded long paper. Particularly, the present invention relates to an apparatus in which the edges of pieces of zigzag-folded paper, which are to be coupled to each other, are exactly positioned to each other in a coupling location.

Long paper for computer data output or the like is housed in a zigzag-folded state in a case. When all the long paper has been consumed out of the case, new long paper needs to be supplied therein. Since the supply and preparation are usually performed all by a person, they arc troublesome work. Besides, since a printer fed with the paper is stopped during the work, the printing efficiency thereof falls.

In order to eliminate such drawbacks, the edges of pieces of long paper are mechanically coupled to each other to enable a printer to continuously work, in conventional arts disclosed in the Japanese Patent Application (OPI) No. 56449/81 and No. 77057/85 (the term "OPI" as used herein means an "unexamined published application"). However, since the long paper is fed by sprockets or tractors in the conventional arts, the size of the long paper is limited to only one kind so that the conventional arts cannot be applied to the other sizes of long paper. This is another drawback.

SUMMARY OF THE INVENTION

The present invention was made in order to eliminate all the above-mentioned drawbacks.

Accordingly, it is an object of the present invention to provide an automatic paper feeder in which the trailing and leading edges of a preceding and a following pieces of long paper are positioned next to each other in abutting location when the edges of the pieces of long paper are to be automatically coupled to each other in the process of supply of the long paper, so that the automatic paper feeder can be applied to different sizes of long paper.

In the automatic paper feeder, four taper pins are inserted into the sprocket holes of the pieces of long paper at the side edges thereof around the trailing and leading edges of the pieces so that the trailing and leading edges of the pieces are positioned to each other both in the direction of feed thereof and in the direction of width thereof in the butting location. For that reason, the trailing and leading edges of the pieces of long paper can be coupled to each other almost as neatly as the halfway portion of each piece of long paper.

One pair of the taper pins are provided at one side edge of the long paper, while the other pair of the taper pins are provided at the other side edge of the long paper. One of the two pairs of the taper pins are located fixedly, while the other are located movably in the direction of width of the long paper so as to be automatically moved to a position corresponding to the size of each long paper. The tip portions of the taper pins are conically shaped, for example, to automatically correct the deviation of the trailing and leading edges of the pieces of long paper as the taper pins are inserted into the sprocket holes of the pieces of long paper, to position the trailing and leading edges of the pieces to each other. After the trailing and leading edges of the pieces of long paper are positioned to each other, the trailing and leading edges are coupled to each other by a tape.

Since the four taper pins are inserted into the sprocket holes of the pieces of long paper, the trailing and leading edges of the pieces of long paper are positioned to each other in an exact and simple manner. Since one of the pairs of the taper pins are located movably in the direction of width of the long paper, the automatic paper feeder can be applied to a plurality of different sizes of long paper.

If the movably located pair of the taper pins are provided on a taping unit, it is not necessary to provide an exclusive means for moving the taper pins.

If the fixedly located pair of the taper pins are provided on the holding plate of a splicing section, positioning and holding-down can be automatically performed by moving down the splicing section.

DETAILED DESCRIPTION OF EXEMPLARY EMBODIMENT

Figure 1:
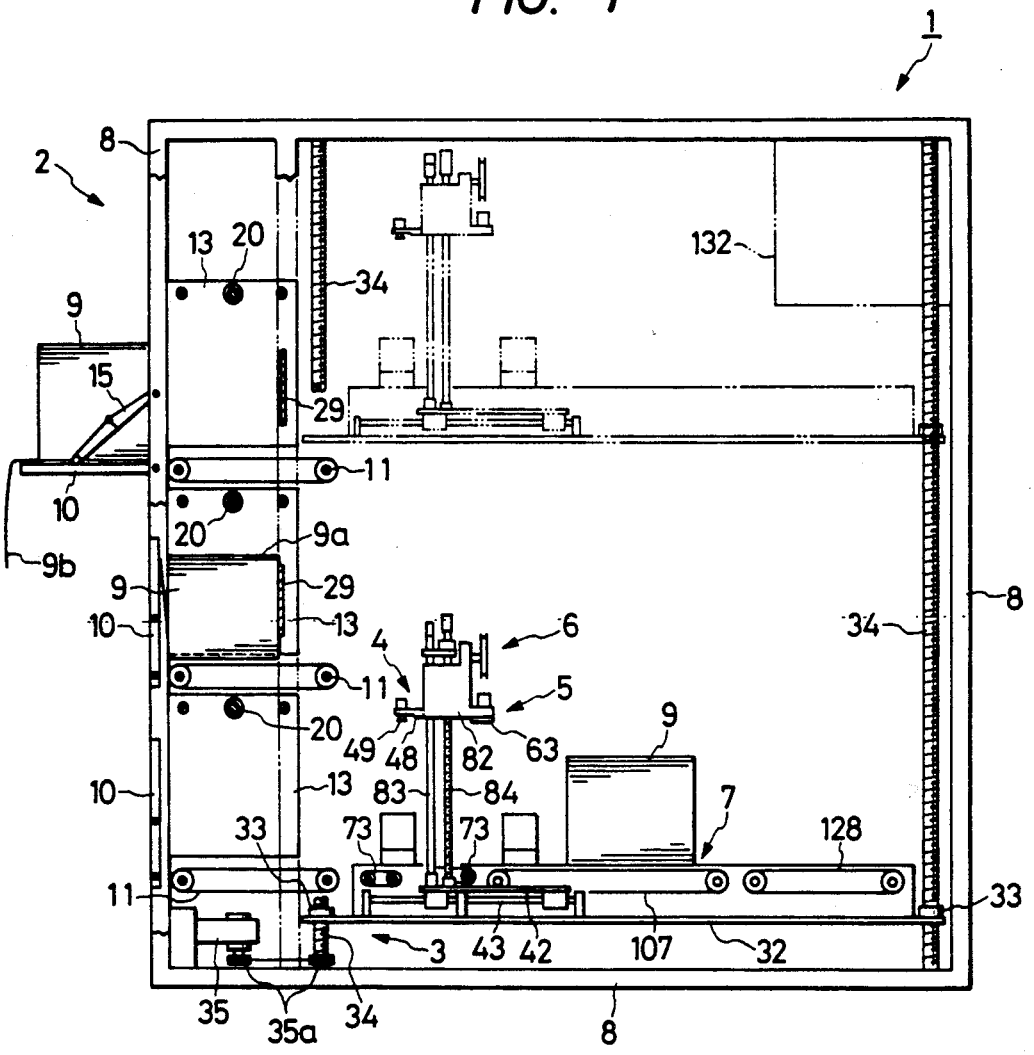
FIG. 1 shows a sectional view of a pair of an automatic paper feeder which is an embodiment of the present invention.

An embodiment of the present invention is hereafter described in detail with reference to the drawings attached hereto.

An automatic paper feeder 1 for long paper 9 is the embodiment, and comprises a stocker 2, a lifting unit 3, a leading edge pull-out unit 4, a coupling positioner 5, a splicer 6 and a sideward true-up unit 7, which are assumed on the prescribed portions of a box-shaped frame 8.

In the stocker 2, the zigzag-folded long paper 9 is stored in the form of a number of layers. The stocker 2 is provided at the inlet opening of the front of the frame 8, and comprises guides 10, which are jointly used as covers, an incoming conveyor 11, and two kinds of side plates 12 and 13.

Figure 3:
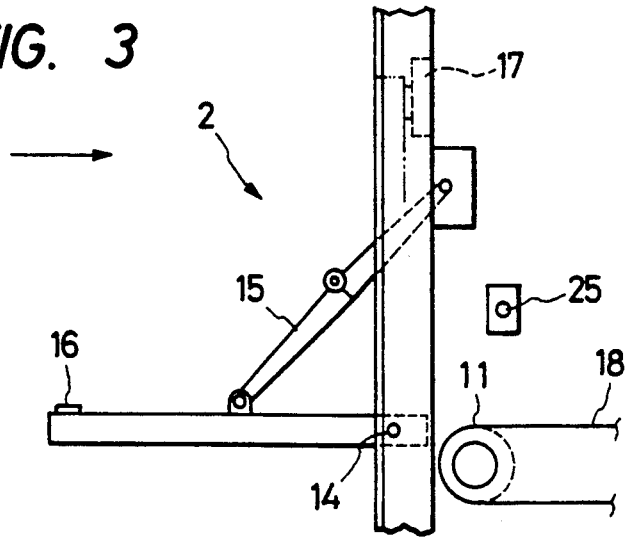
FIG. 3 shows a side view of a major part of a stocker.

As shown in FIG. 1, the guides 10 are provided on three different levels. As shown in FIG. 3, the guides 10 are supported by horizontal shafts on the frame 8 so that the guides can be opened and closed. Besides, each guide 10 can be stopped in a horizontal posture by a link 15 bendable at the halfway portion thereof, and close an open surface through the magnetic attraction of a moving portion 16 and a fixed portion 17.

Figure 2:
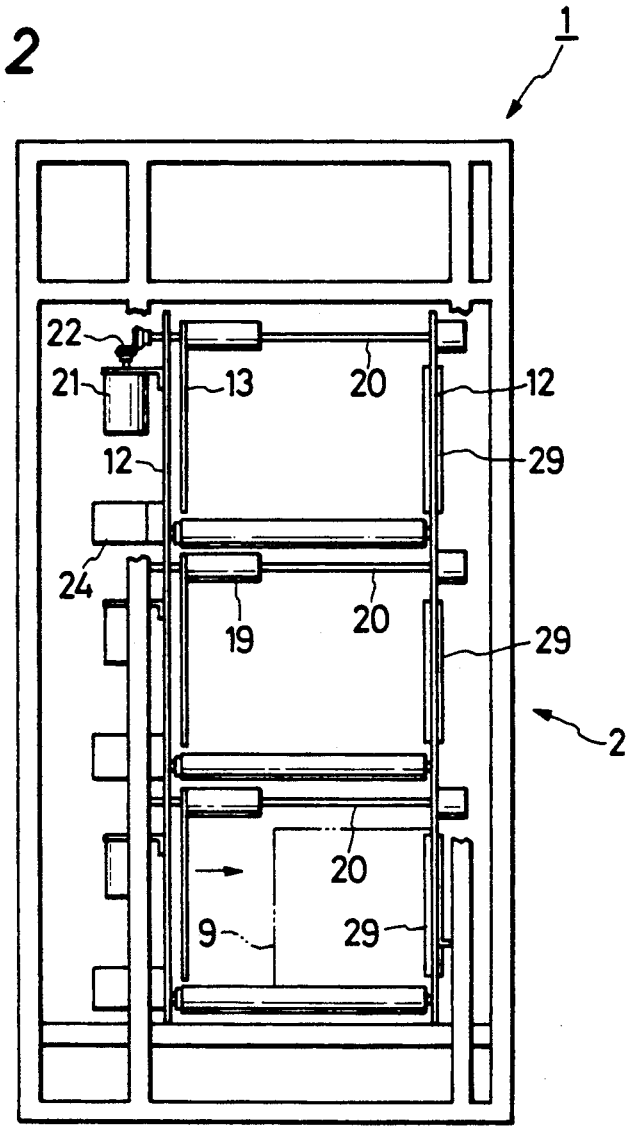
FIG. 2 shows a cutaway front view of the automatic paper feeder.

The incoming conveyor 11 extends horizontally and is made of a conveyance belt 18 of a leek material such as a fluorine resin. The pair of the fixed side plates 12 are provided at both the side edges of the long paper 9 and secured to the frame 8. The fixed side plates 12 located in right-hand positions with regard to FIG. 2 constitute reference surfaces for feeding the long paper 9. The pair of the movable side plates 13 are provided inside the fixed side plates 12 located in left-hand positions with regard to FIG. 2, and are supported at the tops of the movable side plates by moving nuts 19 and moving screws 20 extending in the direction of the width of the long paper 9. The moving screws 20 are driven by drive motors 21 attached to the side plates 12, through bevel gears 22.

Figure 5:
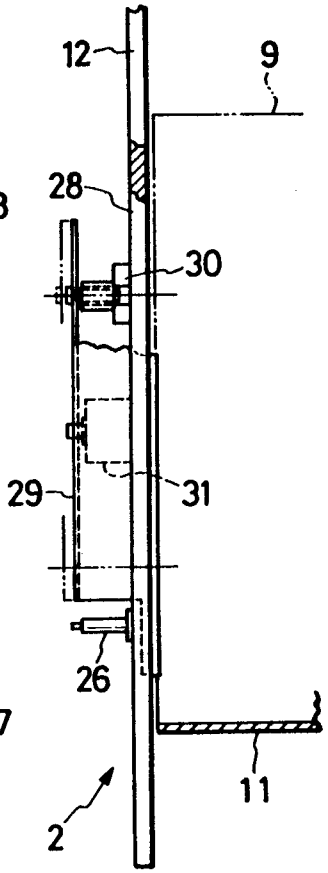
FIG. 5 shows a sectional view of a part of a vertical stopper.
Figure 4:
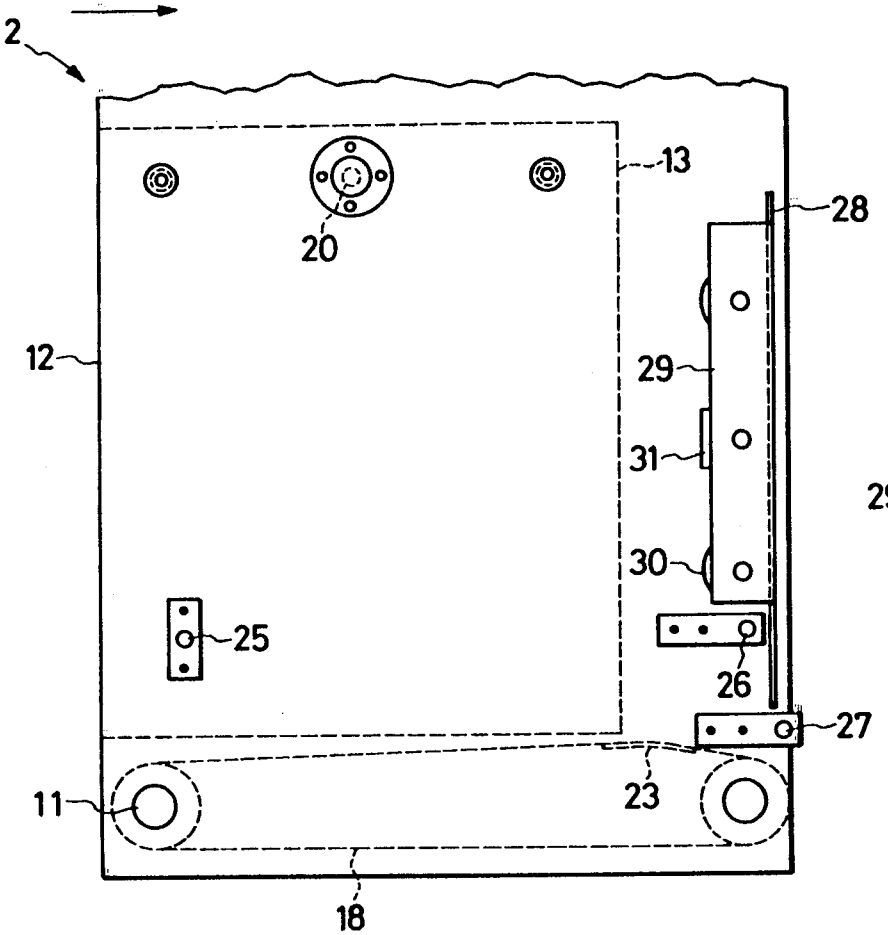
FIG. 4 shows a side view of the stocker.

As shown in FIGS. 4 and 5, an insertion sensor 25 is secured at the upstream (with regard to the flow of the long paper 9) portion of each reference side plate 12, and a prescribed position sensor 26 and an overrun sensor 27 are provided at the downstream portion of the reference side plate so that the overrun sensor is located downstream to the prescribed position sensor. A vertical slit 28 is provided near the prescribed position sensor 26. An L-shaped vertical stopper 29 is provided at the vertical slit 28 so that the stopper extends inward and can be moved to and from the position of passage of the long paper 9, along a vertical guide 30, and can be operated by a driver cylinder 31 between the stopper and the guide.

The incoming conveyor 11 is made slightly higher at the downstream portion thereof by an oblique guide plate 23 than the other portion of the incoming conveyor as shown in FIG. 4, and is driven by a drive motor 24 attached to the side plate 12.

The lifting unit 3 supports the leading edge pull-out unit 4, a part of the coupling positioner 5 and the splicer 6 so that the leading edge pull-out unit, the coupling positioner and the splicer can be moved up and down and moved horizontally in the direction of feed of the long paper 9. The lifting unit 3 comprises a lifter 32 and a means for moving the lifter.

Figure 6:
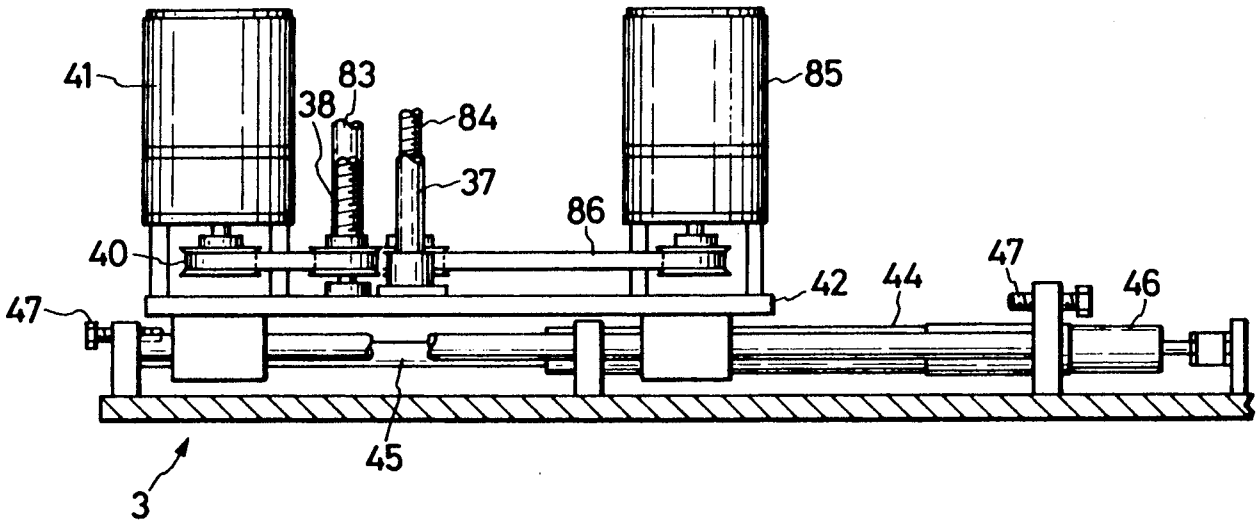
FIG. 6 shows a side view of a drive section for a slider.
Figure 7:
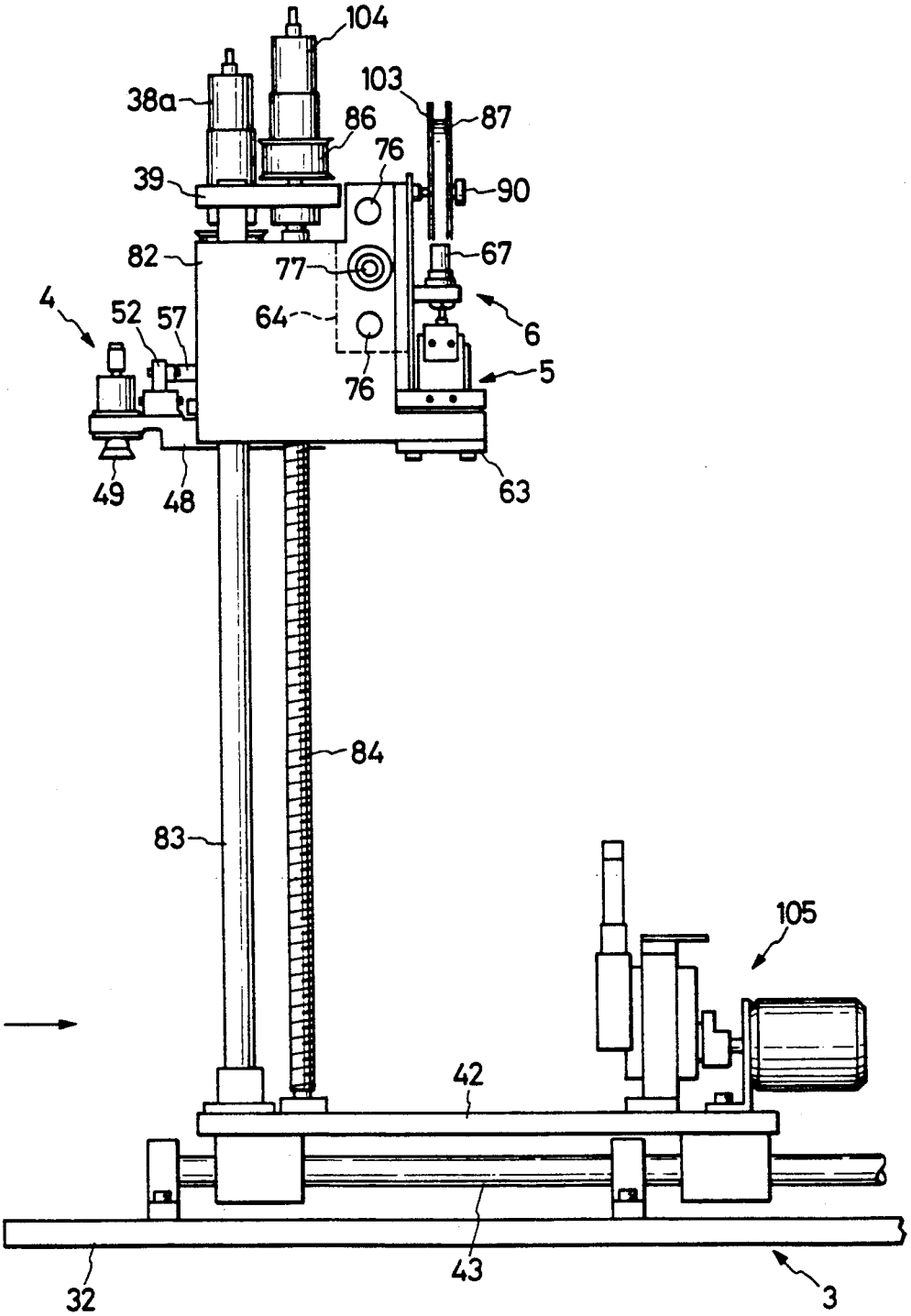
FIG. 7 shows a side view of a leading edge pull-out unit and a splicer.

As shown in FIGS. 1, 6 and 7, the lifter 32 is oblongly shaped as a whole, and has side plates **32*a* and 32*b* at both the sides of the lifter. The lifter 32 is horizontally supported by vertical moving nuts 33 and vertical moving screws 34 at the four corners of the lifter. The moving screws 34 are rotatably supported at the upper and lower ends thereof by the frame 8 so that the screws are synchronously driven by the same quantity of rotation through a speed reducer and drive motor unit 35 and a chain and sprocket unit 35*a*. The leading edge pull-out unit 4, the coupling positioner 5, the splicer 6 and the sideward true-up unit 7 are attached to the lifter 32**.

Figure 11:
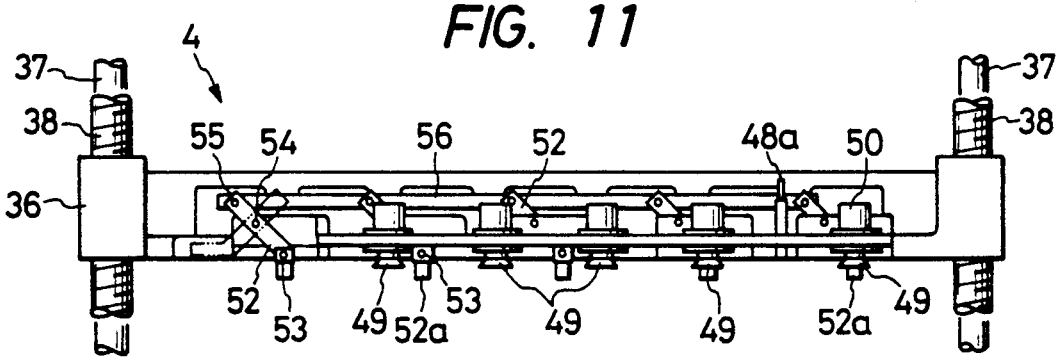
FIG. 11 shows a front view of the major part of the leading edge pull-out unit.
Figure 12:
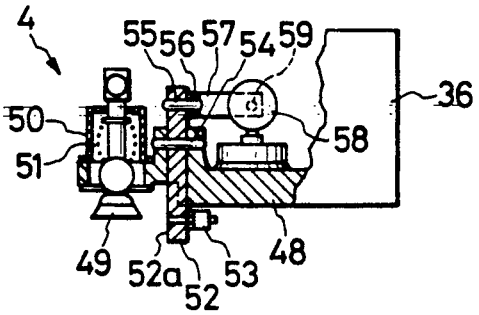
FIG. 12 shows a cutaway side view of the leading edge pull-out unit.

The leading edge pull-out unit 4 is for taking out the leading edge **9*a* of a following piece of long paper 9 and guiding the leading edge to the coupling positioner 5. As shown in FIGS. 11 and 12, the leading edge pull-out unit 4 is provided on a beam body 36**.

Figure 8:
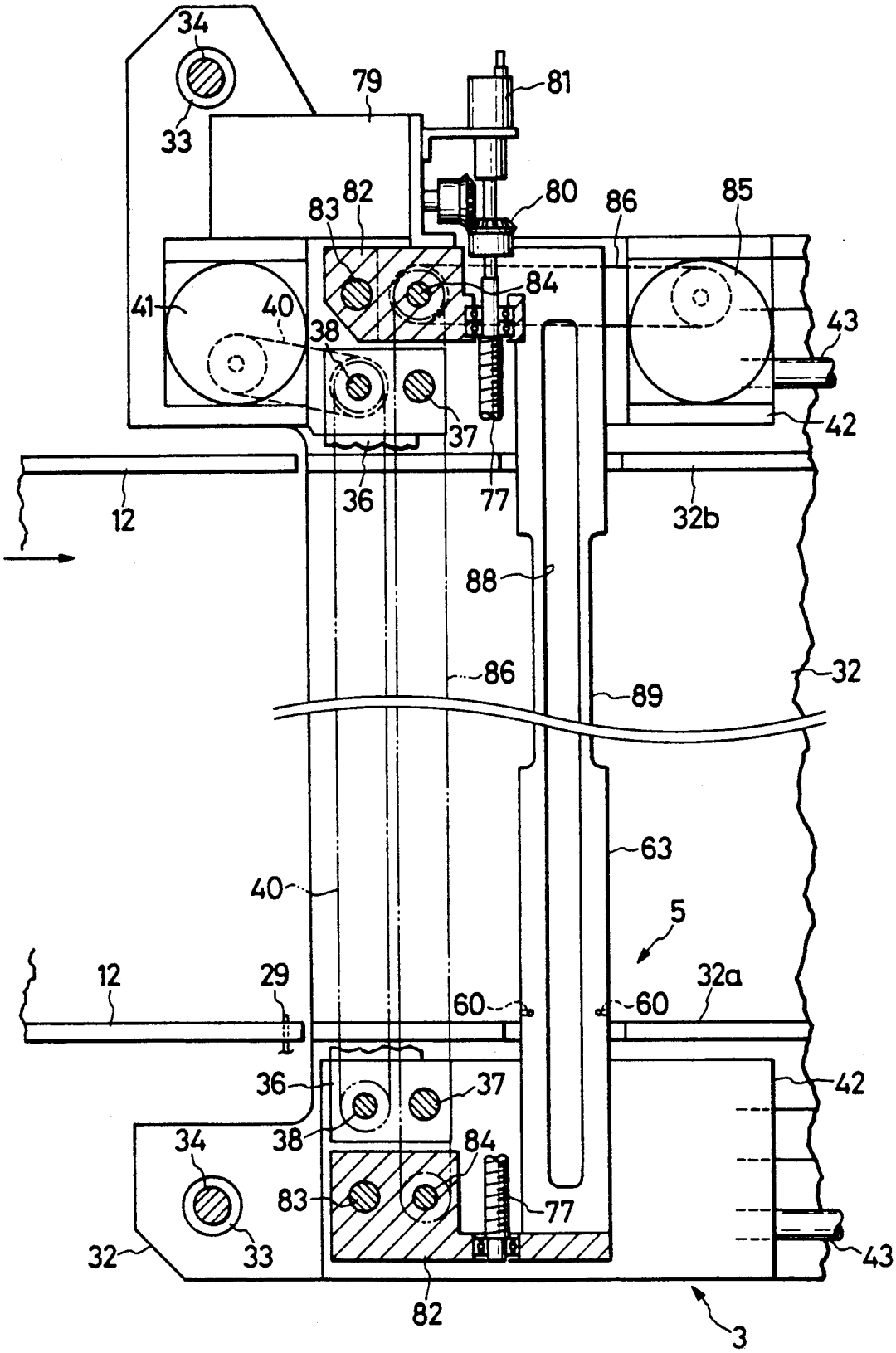
FIG. 8 shows a horizontally sectional view of a vertical drive section.

As shown in FIG. 8, the beam body 36 is slidably supported at both the ends thereof by vertical guide rods 37 and coupled at both the ends of the beam body to moving screws 38 parallel with the vertical guide rods so that the beam body is vertically moved by the rotation of the moving screws. The guide rods 37 and the moving screws 38 are supported at the lower ends thereof by sliders 42, and supported at the upper ends rods and the screws by upper support plates 39. The moving screws 38 are driven in conjunction with each other by a vertical drive motor 41 and a timing belt 40 which are attached to the top of one of the sliders 42. The quantity of movement of the moving screws 38 is detected by an encoder **38*a***.

As shown in FIGS. 6, 7 and 8, the sliders 42 are supported at both the sides thereof by horizontal guide bars 43 so that the sliders can be moved in the direction of feed of the long paper 9. The sliders 42 are connected to the tips of the piston rods 45 of large cylinders 44 for driving. The large cylinders 44 are connected in series with small cylinders 46. The piston rods of the small cylinders 46 are secured to the lifter 32 at the rear ends of the small cylinders. The quantity of the movement of each slider 42 is restricted by a stopper 47 attached to the top of the lifter 32.

Figure 10:
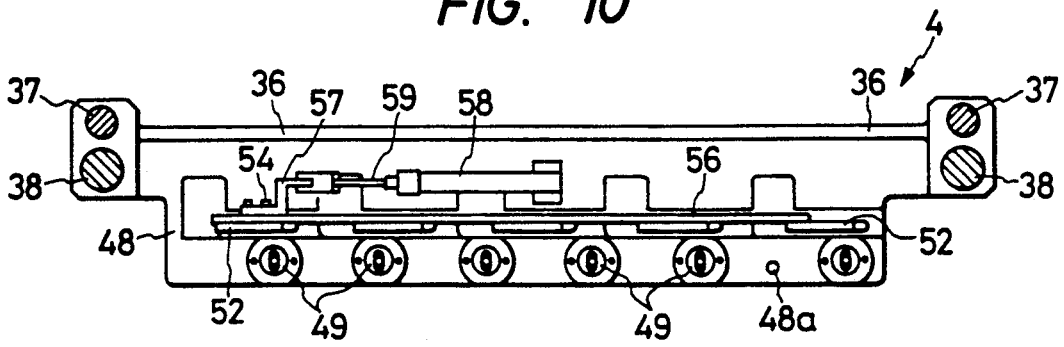
FIG. 10 shows a plan view of a major part of the leading edge pull-out unit.

As shown in FIGS. 10 and 12, a beam portion 48 is integrally provided on the front of the beam body 36. A sensor **48*a* and a plurality of vacuum suction members 49 are provided on the beam portion 48 so that the vacuum suction members are located at prescribed intervals in the direction of the width of the long paper 9 and face downward. Two of the vacuum suction members 49 are located in right-hand positions with regard to FIGS. 10 and 11 so as to be used fixedly and jointly for different sizes of long paper, while the other four vacuum suction members are located in lefthand positions so as to be used interchangeably and selectively for the different sizes of long paper. As shown in FIG. 12, each vacuum suction member 49 is urged upward by a helical spring 51 in a cover 50 so that the vacuum suction member is floatingly supported. The beam portion 48 supports blowing nozzles 53 at the lower ends of rocking arms 52 near the vacuum suction members 49 so that the blowing nozzles are oriented to the bottom of the vacuum suction members. The rocking arms 52 constitute reference surfaces 52*a*, and are rotatably supported by horizontal fulcrum pins 54 extending in the direction of feed of the long paper 9. The rocking arms 52 are connected at the tips thereof to a conjunctive drive rod 56 by connection pins 55. The tip of the piston rod 59 of a rocking cylinder 58 attached to the top of the beam body 36 is connected to the conjunctive drive rod 56 by a coupler 57. The rocking arms 52** may also be referred to as a restrictor.

The coupling positioner 5 functions so that the trailing and leading edges **9*b* and 9*a* of pieces of long paper 9, which are to be coupled to each other, are positioned in a mutually butted state. The coupling positioner 5 comprises pairs of taper pins 60 and 61 and a fixed guide 62 provided on the top of the lifter 32. Each of the pair of taper pins 60 and that of taper pins 61 are located at both the sides of the position in which the trailing and leading edges 9***b* and 9*a* of the pieces of long paper are butted to each other.

Figure 13:
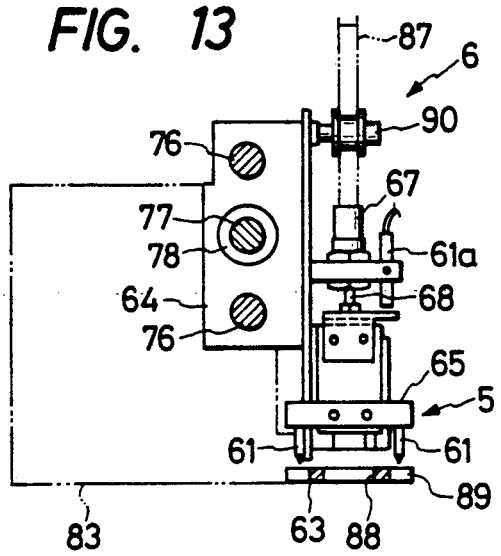
FIG. 13 shows a side view of the splicer.
Figure 15:
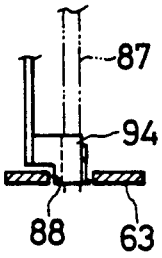
FIG. 15 shows a side view of a tape guide.
Figure 16:
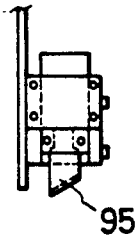
FIG. 16 shows a side view of a cutter.
Figure 14:
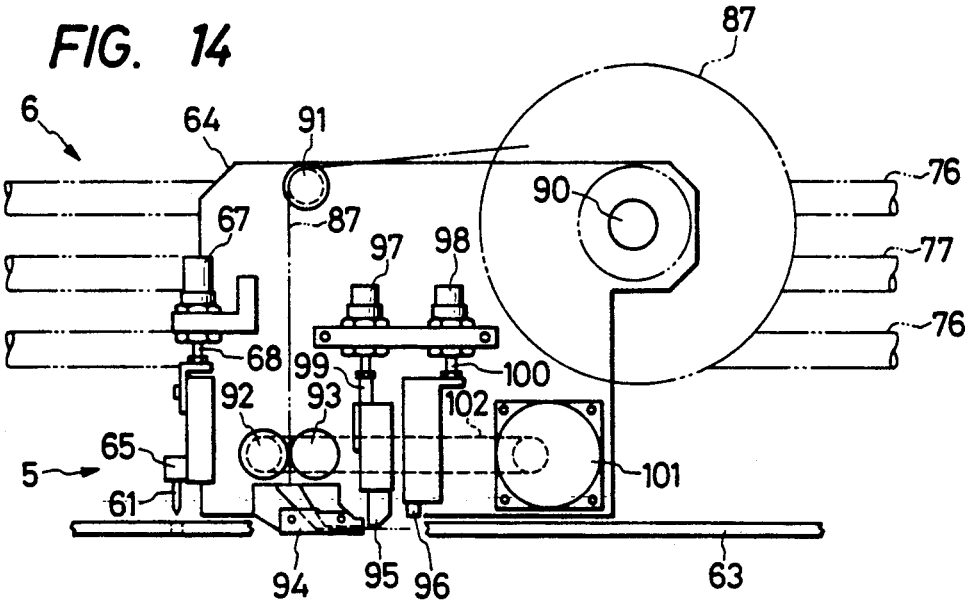
FIG. 14 shows a front view of the splicer.

As shown in FIG. 8, the pair of taper pins 60 are fixedly located on the bottom of the holding plate 63 of the splicer 6 over the reference side plates 32*a* of the lifter 32 and oriented downward so that the taper pins serve as reference position members. As shown in FIGS. 13 and 14, the other pair of taper pins 61 are movably located on a support 65 on a movable body 64 and oriented downward. A sensor 61*a* detects the move-up position of the taper pin 61. The support 65 is borne so that it can be moved up and down. The support 65 is connected at the upper end thereof to the piston rod 68 of a drive cylinder 67. The way the holding plate 63 and the movable body 64 are supported is hereinafter described together with the splicer 6.

Figure 17:
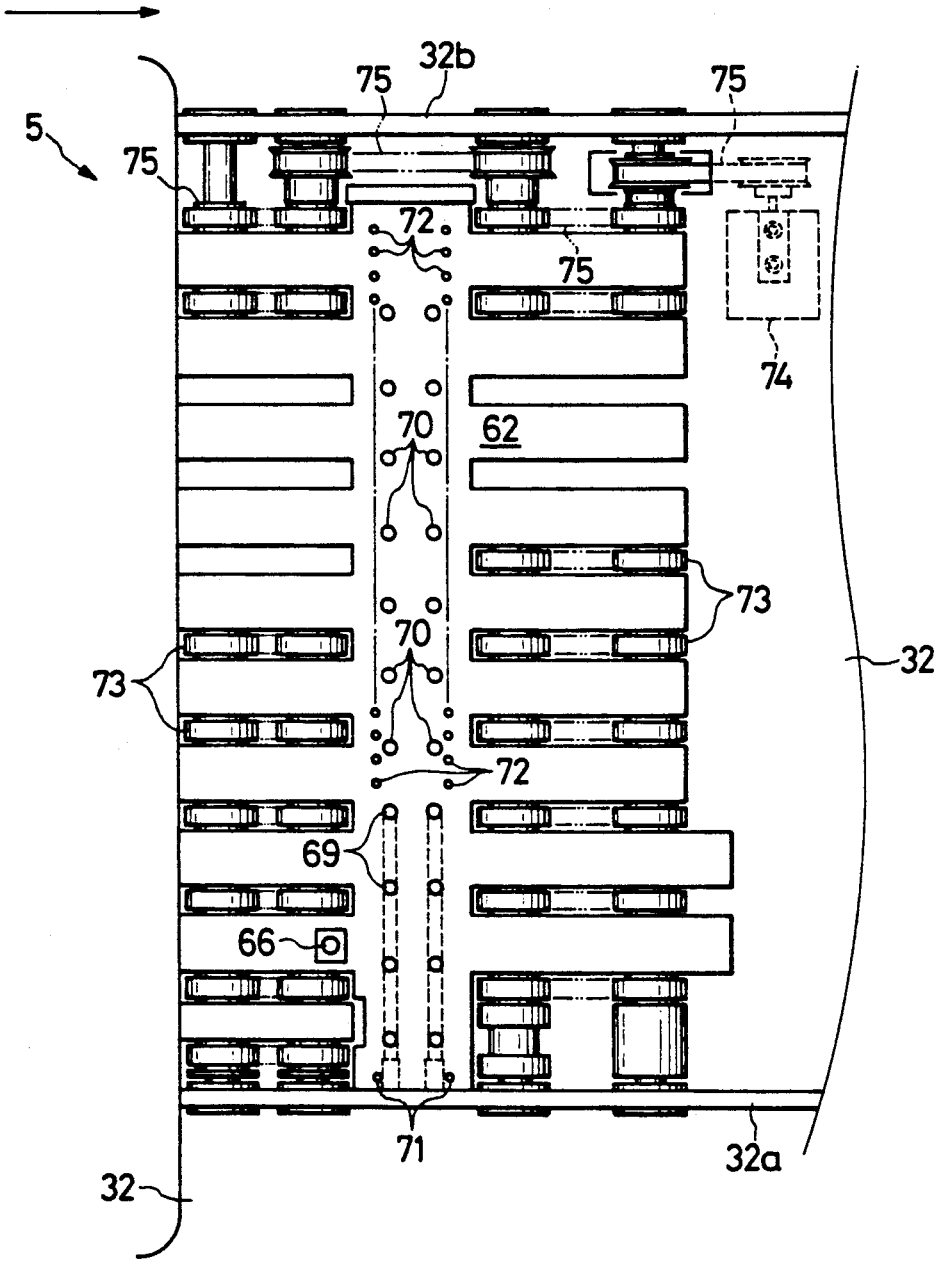
FIG. 17 shows a plan view of the fixed guide of a coupling positioner.

As shown in FIG. 17, the fixed guide 62 is secured to the top of the lifter 32, at the place of the coupling of the pieces of long paper 9, and constitute two rows of jointly-used vacuum suction nozzles 69 near the reference side plate 32*a* of the lifter 32, and other two rows of vacuum suction nozzles 70 which are located nearer the other side plate 32*b* of the lifter than the vacuum suction nozzles 69 so as to be used interchangeably and selectively depending on the size of the long paper 9. The fixed guide 62 has insertion holes 71 provided near the vacuum suction nozzles 69 and 70 and located in positions corresponding to those of the taper pins 60. The fixed guide 62 also has two rows of insertion holes 72 provided for the movably located taper pins 61, and located in positions corresponding to the different sizes of long paper 9. The fixed guide 62 holds a sensor 66 in a position as indicated in FIG. 17 on the fixed guide 62 between two belt conveyors 73. Belt conveyors 73 are located in openings provided in the fixed guide 62 and extending in the direction of feed of the long paper 9, and are juxtaposed in the direction of the width of the long paper. The belt conveyors 73 are supported by the side plates 32*a* and 32*b* of the lifter 3 so that the belt conveyors are driven in the direction of feed of the the long paper 9 by a drive motor 74 and a transmission belt 75 wound thereon. The tops of the belt conveyors 73 are located slightly higher than that of the fixed guide 62.

The splicer 6 is attached to the movable body 64 and functions to couple the mutually-butted trailing and leading edges 9*b* and 9*a* of the pieces of long paper 9 by taping. As shown in FIGS. 7, 13 and 14, the movable body 64 is supported by two horizontal guide bars 76 extending in the direction of the width of the long paper 9, so that the movable body can be moved in the direction of the width of the long paper. The movable body 64 is provided with a moving nut 78 engaged with a moving screw 77 between the guide bars 76, so that the movable body is driven by a drive motor 79 through a bevel gear 80 as shown in FIG. 8. The quantity of rotation of the moving screw 77 is detected by an encoder 81 connected to one end of the moving screw.

Figure 9:
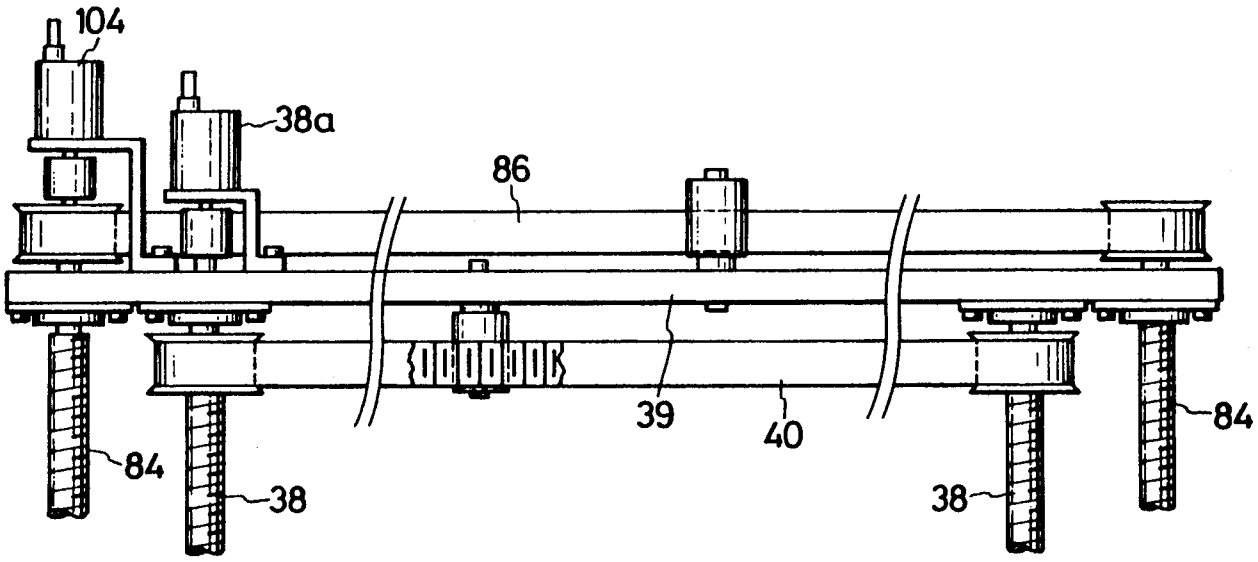
FIG. 9 shows a plan view of a support section for a moving screw.

The guide bars 76 and the moving screw 77 are attached together with the holding plate 63 to a pair of splicing portions 82 which are provided at both the sides of the passage of the long paper 9 and vertically movably supported by vertical guide rods 83 attached to the outer portions of the sliders 42. The pair of splicing portions 82 are connected to a pair of moving screws 84 parallel with the guide rods 83. Similarly to the guide rods 37, the guide rods 83 are secured at the lower ends thereof to the sliders 42 and at the upper ends thereof to the upper support plates 39. The moving screws 84 are rotatably supported at the upper and lower ends thereof by the upper support plates 39 and the sliders 42, as shown in FIGS. 7 and 9, so that the moving screws are driven in conjunction with each other by a vertical drive motor 85 and a timing belt and pulley unit 86. The quantity of vertical movement of the splicing portions 82 is detected by an encoder 104.

A support shaft 90 for bearing a reel 103 for a wound tape 87 is secured to the movable body 64. The tape 87 is thermally fusible, and is guided downward along a guide roller 91 so that the tape enters into a tape guide 94 through between a driving roller 92 and a driven roller 93 and is sent toward an opening 88. A cutter 95 and a heater 96 are disposed at the tip of the tape guide 94, and connected to the lower ends of the piston rods 99 and 100 of operating cylinders 97 and 98 attached to the movable body 64. The driving roller 92 is driven by a tape feed motor 101 and a belt and pulley unit 102 which are attached to the movable body 64. The cutter 95 and the heater 96 are vertically slidably supported by guide frames.

The holding plate 63 has the opening 88 which slenderly extends in the direction of the width of the long paper 9 and is for sticking the coupling tape 87 to the trailing and leading edges of the pieces of long paper along the width thereof. The holding plate 63 also has notches 89 at both the side edges of the holding plate so that the notches allow the movably located taper pins 61 to be moved.

A punch 105 is provided on one of the sliders 42 to make an identification hole in the long paper 9 at the coupled edge thereof.

The sideward true-up unit 7 functions so that after the trailing and leading edges of the pieces of long paper 9 are coupled to each other, the stack-holded long paper is sidewardly pushed onto a reference surface, particularly at the lower portion of the long paper, to exactly regulate the supplied position of the long paper. The sideward true-up unit 7 comprises a pusher 106 for pushing the long paper 9 onto the reference surface, and a belt conveyor 107 extending in the direction of feed of the long paper.

Figure 18:
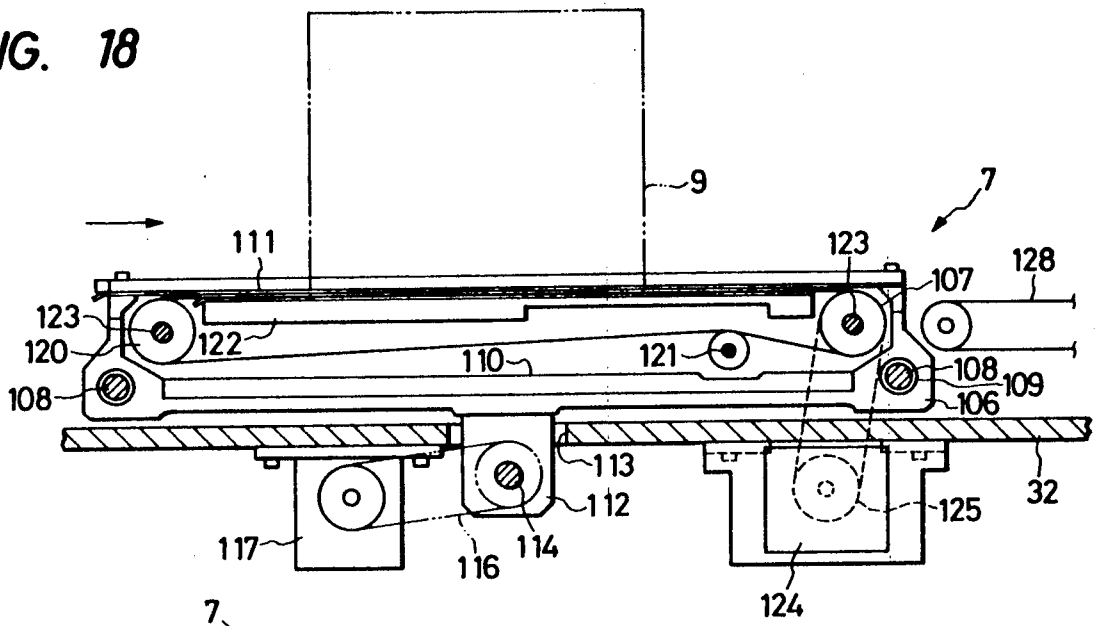
FIG. 18 shows a sectional view of a sideward true-up unit.
Figure 19:
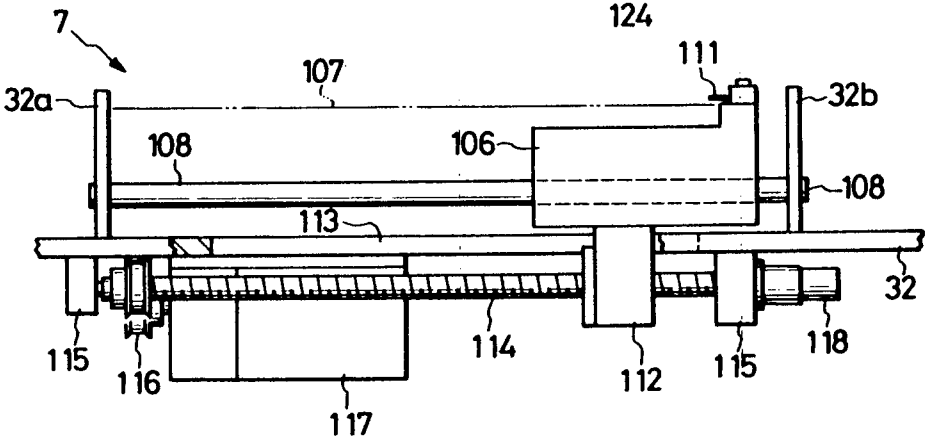
FIG. 19 shows a front view of the sideward true-up unit.
Figure 20:
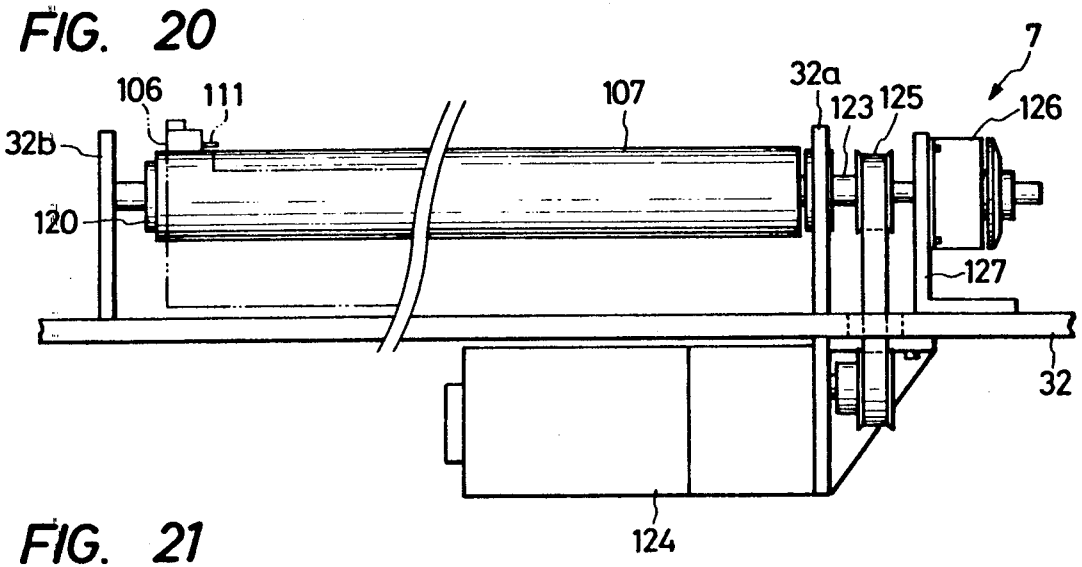
FIG. 20 shows a rear view of a conveyer drive section.

The pusher 106 is disposed downstream to the coupling positioner 5 with regard to the direction of feed of the long paper 9. As shown in FIGS. 18 and 19, the pusher 106 is fitted with bushings 109 on a pair of guide bars 108 extending in the direction of the width of the long paper 9, so that the pusher can be moved in the direction of the width of the long paper. An opening 110 for keeping the pusher 106 out of contact with the belt conveyor 107 is provided between the guide bars 108. An L-shaped guide plate 111, which is located in contact with the side and bottom of the stack-folded long paper 9, is secured to the top of the pusher 106. The guide plate 111 is disposed slightly higher than the top of the belt conveyor 107 and slants down outward at the paper guide portion of the guide plate. The guide bars 108 are supported by the reference side plate 32*a* of the lifter 32 and the opposite side plate 32*b* thereof.

The pusher 106 is provided with a nut 112 which is located at the bottom of the pusher and connects the pusher to a moving screw 114 provided under the slender hole 113 of the lifter 32 and extending in parallel with the guide bars 108. The moving screw 114 is rotatably supported at both the ends thereof by bearing blocks 115 at the bottom of the lifter 32 so that the moving screw is driven by an electromagnetically braked motor 117 and a timing belt and pulley unit 116. The quantity of rotation of the moving screw 114 is detected by an encoder 118 connected to one end thereof.

The belt conveyor 107 is made of an endless belt of a small-friction-coefficient material such as a fluorine resin. The belt is wound on rollers 120 so that the width of the wound portion of the belt on the rollers is larger than that of the long paper 9, and the belt is moved at the upper strand thereof on a belt guide 122. The tension of the belt of the belt conveyor 107 is adjusted by changing the position of a tension roller 121 provided halfway thereon. The rollers 120 are supported by two shafts 123 on the side plates 32*a* and 32*b* of the lifter 3 so that the rollers are driven at a prescribed speed by a conveyor motor 124 and a timing belt and pulley unit 125 connected thereto. Although the gap between the belt conveyor 107 and the reference side plate 32*a* of the lifter 32 is very small, that between the belt conveyor and the other side plate 32*b* of the lifter is not very small. An electromagnetic brake 126 is connected to one end of the shaft 123 of the belt conveyor 107 so that the belt conveyor can be stopped immediately after finishing the feeding action thereof. The electromagnetic brake 126 is attached to the top of the lifter 32 by a bracket 127.

Figure 21:
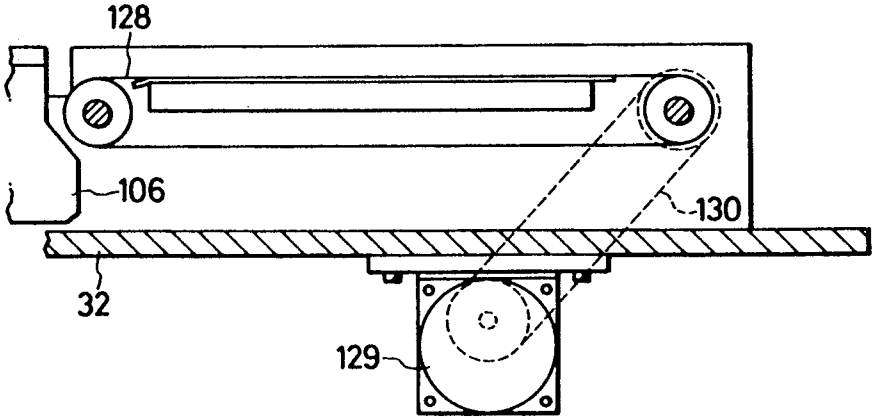
FIG. 21 shows a sectional view of an auxiliary conveyor.

As shown in FIG. 21, an auxiliary conveyor 128 is provided downstream to the belt conveyor 107 with regard to the direction of feed of the long paper 9 so that the the auxiliary conveyor is driven by a drive motor 129 and a belt and pulley unit 130 faster than the belt conveyor.

The above-mentioned equipment of the automatic paper feeder 1 is sequentially regulated by control means comprising a sequence controller 132 while the operation in each process is being confirmed. The sequence controller 132 is installed in an appropriate position on the frame 8 to detect the movement of every portion or part through limit switches and the above-mentioned sensors and act to drive the motors and so forth.

As mentioned above, the long paper 9 is folded zigzag to such a volume that the paper can be housed in a case. The description hereinafter is started on the assumption that the long paper 9 is not present in the automatic paper feeder 1.

An operating person first checks the size of the long paper 9 and enters data corresponding to the size, into the controller 132. As a result, the movable members of the stocker 2, the leading edge pull-out unit 4, the coupling positioner 5, the sideward true-up unit 7 and so forth are moved to prescribed positions, and the vacuum suction members 49, the vacuum suction nozzles 70 and so forth are set in such states that they can act depending on the size of the long paper 9.

Figure 22:
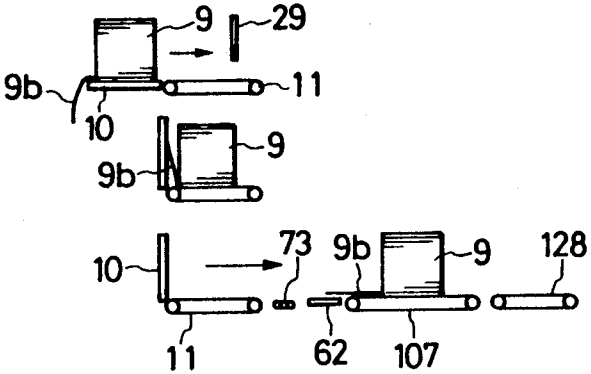

The operating person thereafter takes out the long paper 9 out of the case, and opens the guide 10. He puts the long paper 9 on the guide 10 so that only the lowermost layer of the long paper hangs. He then pushes in the long paper 9 in the direction of feed thereof. At that time, the presence of the long paper 9 is detected by the insertion sensor 25 to start the drive motor 24 to move the incoming conveyor 11 in the direction of feed of the long paper. As a result, the long paper 9 is moved inward. During the movement of the long paper 9, the movement is detected by the prescribed position sensor 26 so that the incoming conveyor 11 is immediately stopped. At that time, the corner of the long paper 9 at the leading edge thereof is stopped in contact with the vertical stopper 29. In the meantime or in the process of feed of the long paper 9, the motor 21 rotates the moving screw 20 so that the movable side plate 13 is reciprocated toward and away from the reference side plate 12 several times. As a result, the long paper 9 is pushed by the movable side plate 13 so that the paper is positioned on the reference side plate 12. When the opened guide 10 is thereafter closed by the operating person, the long paper 9 is loaded in the stocker 2 as the trailing edge 9*b* of the long paper and the guide put in contact with the rear of the folded long paper. Pieces of long paper 9 are thus loaded in the three-level stocker 2 sequentially, as shown in FIG. 22. After that, the operating person performs a manipulation to move the vertical stopper 9 back by the drive cylinder 31 to make it possible to send the long paper 9 in the direction of feed thereof.

When the long paper 9 is loaded in a positioned state in the lowermost section of the stocker 2, the loading is detected by the prescribed position sensor 26 so that the incoming conveyor 11 and the belt conveyors 73 and 107 start moving in the direction of feed of the long paper. As a result, the lowermost long paper 9 is automatically moved by the conveyors 11, 73 and 107 until the paper is stopped on the belt conveyor 107. During the movement of the long paper 9 onto the belt conveyor 107, the trailing edge 9*b* of the long paper 9 falls backward so that the trailing edge is detected by the sensor 66 upstream to the vacuum suction nozzles 69 and 70 to stop the incoming conveyor 11 and the belt conveyors 73 and 107 under prescribed conditions. At that time, the trailing edge 9*b* of the long paper 9 stops nearly in a prescribed position on the transverse center line of the fixed guide 62.

Before or after the long paper 9 is moved to the belt conveyor 107 of the sideward true-up unit 7, the motor 117 is put in action to reciprocate the pusher 106 toward and away from the reference side plate 32*a* of the lifter 32 several times to push the folded long paper 9 into a true-up state on the reference side plate. The long paper 9 is thus slipped on the belt conveyor 107 as the long paper remains present on the guide plate 111, so that the long paper is positioned. Since the electromagnetic brake 126 acts as soon as the belt conveyor 107 is stopped, the trailing edge 9*b* of the long paper 9 is exactly positioned on the fixed guide 62. The lowermost long paper 9 is thus first moved into the automatic paper feeder 1, as shown in FIG. 22.

After that, the speed reducer and drive motor unit 35 is automatically started to move up the lifter 32 by the moving nuts 33 and the moving screws 34 to automatically stop the lifter at the middle of the height of the intermediate long paper 9. At that time, the beam portion 48 and the splicing portions 82 are slightly moved down by the rotation of the vertical drive motors 41 and 85 and stopped on such a level that the beam portion and the splicing portions can be moved to a position over the intermediate long paper 9 without coming into contact with the upper section of the stocker 2. The large cylinders 44 are thereafter put in action to move the sliders 42 in the direction reverse to that of feed of the long paper 9 to place the vacuum suction members 49 of the beam portion 48 over the intermediate long paper 9.

The beam portion 48 is then moved down. When the top of the intermediate long paper 9 is detected by the sensor 48*a* of the beam portion, the downward movement of the beam portion 48 is automatically stopped. After that, means for moving the beam portion 48 comprising the small cylinders 46 are put in action to horizontally move the sliders 42 further in the direction reverse to that of feed of the long paper 9. When the sliders 42 are moved as mentioned above, the leading edge pull-out unit 4 and the splicer 6 which are provided on the sliders are moved together with the sliders. Because of the movement of the beam portion 48, the top of the downstream portion of the intermediate long paper 9 comes into contact with the reference surfaces 52*a* of the rocking arms 52 so that the paper is slightly pushed in for sure positioning.

The beam portion 48 is moved down again. The vacuum suction members 49 attract the uppermost layer of the long paper 9 by suction. The beam portion 48 is then moved up. The vacuum suction members 49 correspond to the portion of the long paper 9, which is made slightly higher than the other portion thereof by the oblique guide plate 23 of the stocker 2. During the upward movement of the beam portion 48, the rocking arms 52 are driven by the cylinder 58 as the blowing nozzles 53 eject air to the downstream surface of the folded long paper 9 to prevent a plurality of layers of the paper from being attracted by the vacuum suction members 49 by suction.

Figure 23:
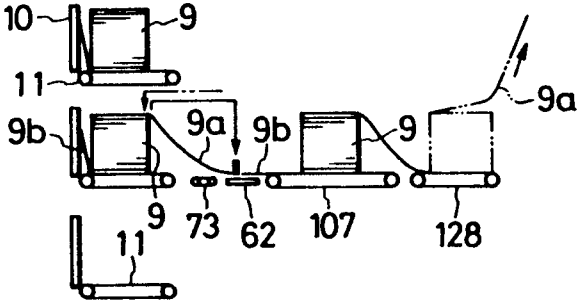

After that, the beam portion 48 is horizontally moved in the direction of feed of the long paper 9 by the large cylinders 44 and the small cylinders 46 and then moved down along the guide rods 37 by the moving screws 38 and the vertical drive motor 41 so that the leading edge 9*a* of the long paper 9 at the suction-attracted layer thereof is moved onto the fixed guide 62 of the coupling positioner 5, as shown in FIG. 23. At that time, since negative-pressure air is sent through the vacuum suction nozzles 69 and 70, the leading edge 9*a* of the intermediate long paper 9 and the trailing edge 9*b* of the already-moved-in lowermost long paper 9 are butted to each other on the fixed guide 62. After that, the vacuum suction members 49 stop attracting the intermediate long paper 9 by suction, and the beam portion 48 is moved up to the original position thereof as the leading edge 9*a* of the intermediate long paper is left on the fixed guide 62. At that time, the rocking arm 52 are returned to the original positions thereof.

Figure 24:
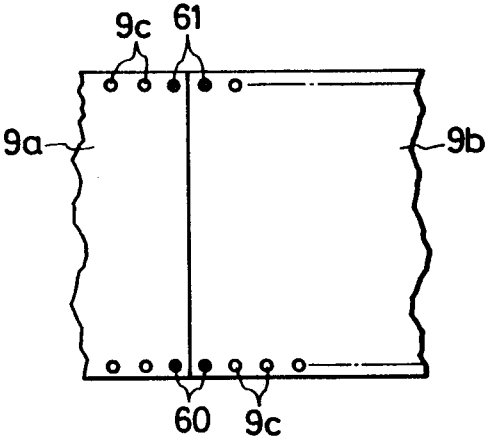
FIGS. 22, 23, 24 and 25 show operation explanatory views.
Figure 25:
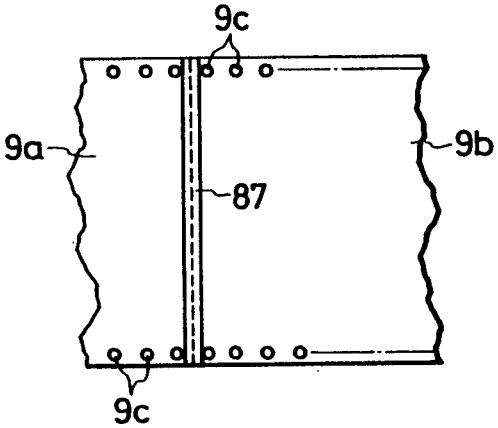

After that, the coupling positioner 5 and the splicer 6 are moved by the large cylinders 44 and the small cylinders 46 in the direction reverse to that of feed of the long paper 9 so that the movable body 64 for taping is placed over the edges of the lowermost and intermediate pieces of long paper 9. The two movably-located taper pins 61 are protruded down by the drive cylinder 67. The splicing portions 82 are moved down by the vertical drive motor 85. During the downward movement of the splicing portions 82, the taper pins 60 under the holding plate 63 and the protruded movably-located taper pins 61 are inserted into sprocket holes 9*c* made in the lowermost and the intermediate pieces of long paper 9 at both the side edges thereof, to exactly position the leading edge 9*a* of the intermediate long paper 9 and the trailing edge 9*b* of the already-moved-in lowermost long paper 9, as shown in FIG. 24. At that time, if the lowermost and the intermediate pieces of long paper 9 have deviated within a tolerance equal to the radius of each of the taper pins 60 and 61, the deviation is corrected as the taper pins are inserted into the sprocket holes 9*c* of the pieces of long paper. In other words, since the diameter of each of the thicker portions of the taper pins 60 and 61 is equal to that of each of the sprocket holes 9*c*, the deviation of the long paper 9 can be corrected as the taper pins are moved down into the sprocket holes.

The positioned leading and trailing edges 9*a* and 9*b* of the intermediate and the lowermost pieces of long paper 9 are thereafter held down by the holding plate 63. As a result, the downward movement of the splicing portions 82 is automatically stopped.

Subsequently, the movably located taper pins 61 are moved up. The movable body 64 is then slightly moved leftward with regard to FIG. 14 and stopped at the leading and trailing edges of both the pieces of long paper 9. The movable body 64 is thereafter moved toward the reference side plate 32*a* of the lifter 32 (leftward with regard to FIG. 14) by the drive motor 79. During the movement of the movable body 64, the tape feed motor 101 is rotating the driving roller 92 in such a direction as to feed the tape 87. As a result, the tape 87 is gradually fed onto the leading and trailing edges 9*a* and 9*b* of both the pieces of long paper 9 through the slender opening 88 of the holding plate 63 while being guided by the tape guide 94, as shown in FIG. 14. The tape 87 is then heated by the heater 96 so that the tape is stuck to the leading and trailing edges 9*a* and 9*b* of both the pieces of long paper 9. After the cutter 95 is opposed to the leading and trailing edges 9*a* and 9*b* of both the pieces of long paper 9 immediately before the taping thereof is completed, the cutter is protruded by the operating cylinder 97 to cut off the tape 87. Since the movable body 64 is still moved after the tape 87 is cut off, the cut-off piece of the tape is stuck to the leading and trailing edges 9*a* and 9*b* of both the pieces of long paper along the total width thereof as the edges remain completely butted to each other. At that time, the punch 105 is automatically put in action to make the identification hole in the butted joint of both the pieces of long paper 9. The splicing portions 82 are thereafter moved up, thus completing the splicing of both the pieces of long paper 9.

After that, the beam portion 48 and the splicing portions 82 are horizontally moved in the direction of feed of the long paper 9 by the large cylinders 44 and the small cylinders 46. The lifter 32 is then moved down so that the incoming conveyor 11 of the intermediate section of the stocker 2 and the belt conveyors 73 extend continuously to each other on the same level. At that time, the beam portion 48 and the splicing portions 82 are moved up to the original positions thereof.

Subsequently, the incoming conveyor 11, the belt conveyors 73, the belt conveyor 107 and the auxiliary conveyor 128 are all driven in the direction of feed of the long paper 9 so that the preceding piece of long paper 9 is moved from the belt conveyor 107 to the auxiliary conveyor 128, and the following piece of long paper 9 is moved to the belt conveyor 107 of the sideward true-up unit 7, sidewardly trued up and then stopped in the same manner as the preceding piece of long paper. The speed of feed of the long paper 9 from the auxiliary conveyor 128 is higher than that of feed thereof from the other conveyors so that the long paper is rapidly fed from the auxiliary conveyor to a prescribed supply position.

The long paper 9 on the auxiliary conveyor 128 is thus fed to a printer or the like so that the paper is sequentially pulled into it as the operation of the printer or the like progresses.

Every time the long paper 9 on the auxiliary conveyor 128 runs out, a series of actions are repeated so that the following long paper 9 coupled to the preceding long paper 9 at the edges as described above is fed to the prescribed supply position. For that reason, if the following long paper 9 is loaded in the stocker 2 long before the preceding long paper 9 in the prescribed supply position is all consumed, there is an enough time not to be affected by the speed of the consumption of the long paper by the printer or the like, thus making it possible to easily load the following long paper.

The taper pins 60 and 61 are not limited to being conically shaped, but may be otherwise shaped. Besides, the taper pins 60 and 61 are not limited to being moved down into the sprocket holes of the pieces of long paper 9, but may be moved up from the fixed guide 62 into the sprocket holes of the pieces of long paper.

Sidewardly pushing the long paper 9 onto the reference side plate 32*a* of the lifter 32 to true-up the long paper may be performed either during the feed thereof or during the stoppage thereof.

If the belt conveyor 107 is made of a single belt of a small-friction-coefficient material or made of a plurality of such belts laid on the same level, the long paper 9 can be pushed sideward onto the reference side plate 32*a* of the lifter 3 by a relatively weak force so as to be trued up.

The means for moving the sliders 42 in the direction of feed of the long paper 9 or in the direction reverse to that of feed of the long paper are not limited to being the large cylinders 44 and the small cylinders 46, but may be moving screw units.

Although the blowing nozzles 53 are provided to prevent a plurality of layers of the folded long paper from being pulled out, such a preventive function can be performed by the simple swing-down actions of the rocking arms 52 as well.

What is claimed is:

1. An automatic paper feeder which automatically couples a plurality of pieces of folded long paper to each other and then continuously feeds said pieces, comprising:

a conveyance means for conveying said long paper; sliders;

a beam supported by said sliders so that said beam can be moved perpendicularly to the surface of said long paper;

suction members disposed on said beam and juxtaposed along the width of said long paper;

a detection means for detecting the uppermost layer of said folded long paper; and a restrictor disposed on said beam and having a reference surface which faces in the direction reverse to that of conveyance of said long paper, said reference surface contacting said long paper so that said long paper is pushed in for sure positioning; control means; and means for moving said beam toward a surface facing in the direction of conveyance of said long paper responsive to said control means when the uppermost layer of said folded long paper is detected by said detection means to position the edge to be coupled of said long paper below said suction members, wherein said restrictor having the reference surface restricts said long paper and is movable between a position in which said restrictor is protruded toward the paper suction surfaces of said suction members and a position in which said restrictor is retracted away from said paper suction surfaces; and when said long paper is set in a position to be coupled, said restrictor is in said position in which said restrictor is retracted away from said paper suction surfaces.

2. An automatic paper feeder according to the claim 1, wherein the conveyance means comprises two conveyors which are separated from each other in a position in which the pieces of folded long paper are coupled and can be driven independently of each other.

3. An automatic paper feeder which automatically couples a plurality of pieces of folded long paper to each other and then continuously feeds said pieces, comprising:

a conveyance means;

two reference pins;

two or more positioning pins; and a moving means; said conveyance means conveying said long paper; said reference pins being disposed at the conveyance reference side edge of said long paper and located fixedly with regard to the direction of the width of said long paper; said positioning pins being located movably both perpendicularly to the surface of said long paper and along the width of said long paper; said moving means for moving said positioning pins: and said positioning pins movable relative to said reference pins so that a plurality of pieces of long paper, having different widths from each other, can be automatically positioned so that a first piece of long paper having a first width will be positioned next to a second piece of paper with a second width, further comprising a beam having said two or more positioning pins mounted thereon, and which is movable perpendicularly to the surface of the long paper; wherein the two reference pins are movable simultaneously with said beam.

4. An automatic paper feeder according to claim 3, wherein the two reference pins and the two or more positioning pins are movable toward and away from the surface of the long paper independent of the movement of said beam.

5. An automatic paper feeder which automatically couples a plurality of pieces of long paper to each other and then continuously feeds said pieces, comprising:

a conveyance means, a suction and conveyance means, a positioning means, and a coupling means; said conveyance means for conveying said long paper; said suction and conveyance means for sucking and conveying the uppermost layer of the following piece of folded long paper to a position to be coupled in which said uppermost layer is coupled to the lowermost layer of the preceding piece of folded long paper; said suction and conveyance means being movable in the direction of the conveyance of said long paper and in a direction perpendicular to the surface of said long paper; said uppermost layer and said lowermost layer being positioned in said position to be coupled by said positioning means; said positioning means comprises two reference pins located fixedly with regard to the direction of the width of said long paper, and two positioning pins located movably both perpendicularly to the surface of said long paper and along the width of said long paper; said uppermost layer and said lowermost layer which are positioned being coupled to each other by said coupling means; and said coupling means being movable perpendicularly to the surface of said long paper and along the width of said long paper, and wherein the suction and conveyance means, the positioning means and the coupling means are attached together to a beam which is movable perpendicularly to the surface of the long paper and disposed on sliders which are movable in the direction of conveyance of said long paper.

6. An automatic paper feeder which automatically couples a plurality of pieces of folded long paper to each other and then continuously feeds said pieces, comprising:

a conveyance means for conveying said long paper;

at least one reference pin, said at least one reference pin being disposed at the conveyance reference side edge of said long paper and located fixedly with regard to the direction of the width of said long paper;

at least one positioning pin, said at least one positioning pin being located movably both perpendicularly to the surface of said long paper and along the width of said long paper;

a moving means for moving said at least one positioning pin, said at least one positioning pin being movable relative to said at least one reference pin so that a plurality of pieces of long paper, having different widths from each other, can be automatically positioned so that a first piece of long paper having a particular width will be positioned next to a second piece of paper with a different width; and a beam having said at least one positioning pin mounted thereon, and which is movable perpendicularly to the surface of the long paper, wherein said at least one reference pin is movable simultaneously with said beam.

7. An automatic paper feeder which automatically couples a plurality of pieces of folded long paper to each other and then continuously feeds said pieces, comprising:

a conveyance means for conveying said long paper;

a suction and conveyance means for sucking and conveying the uppermost layer of the following piece of folded long paper to a position to be coupled in which said uppermost layer is coupled to the lowermost layer of the preceding piece of folded long paper, said suction and conveyance means being movable in the direction of the conveyance of said long paper and in a direction perpendicular to the surface of said long paper;

a positioning means for positioning said uppermost layer and said lowermost layer in said position to be coupled, said positioning means comprising at least one reference pin located fixedly with regard to the direction of the width of said long paper, and at least one positioning pin located movably both perpendicularly to the surface of said long paper and along the width of said long paper; and a coupling means for coupling said uppermost layer and said lowermost layer positioned by said positioning means, said coupling means being movable perpendicularly to the surface of said long paper and along the width of said long paper, wherein the suction and conveyance means, the positioning means, and the coupling means are attached together to a beam which is movable perpendicularly to the surface of said long paper and disposed on sliders which are movable in the direction of the conveyance of said long paper.

* * * * *